United States Patent [19]

Cordes et al.

[11] 4,362,408

[45] Dec. 7, 1982

[54] MEANS FOR AVOIDING ACCIDENTAL ACTUATION OF A CRITICAL FUNCTION KEY

[75] Inventors: Richard E. Cordes, Kettering; Ronald J. Sears, Middletown, both of Ohio

[73] Assignee: NCR Corporation, Dayton, Ohio

[21] Appl. No.: 211,598

[22] Filed: Dec. 1, 1980

[51] Int. Cl.[3] ..... B41J 5/26

[52] U.S. Cl. ..... 400/481; 400/491; 400/491.2; 400/491.3; 200/159 R; 340/365 E

[58] Field of Search ..... 400/480, 481, 490, 491, 400/491.1, 491.2, 491.3, 495.1; 200/159 R, 159 B, 159 A, 340, 5 A; 340/365 E; 235/145 R

[56] References Cited

U.S. PATENT DOCUMENTS 3,964,593 6/1976 Pointon ..... 400/491.3
4,132,487 1/1979 Fisher ..... 400/479.1

FOREIGN PATENT DOCUMENTS 692659 8/1965 Italy ..... 200/159 B

OTHER PUBLICATIONS

IBM Technical Disclosure Bulletin, vol. 17 No. 1 June 1974 "Dual-Force Automatic Rekeying", J. E. Fox pp. 164-165.

*Primary Examiner*—Paul T. Sewell
*Assistant Examiner*—Daniel J. Roock
*Attorney, Agent, or Firm*—J. T. Cavender; Albert L. Sessler, Jr.; Elmer Wargo

[57] ABSTRACT

A keyboard having a plurality of keys thereon, with each key being moveable from a rest position along an actuation path having a makepoint therealong, whereby completion of an electrical circuit is effected by moving a key with a predetermined force along its actuation path to its associated said makepoint. Each of the keys has means for restoring it towards its rest position. At least one of the keys is designated as a special key and it has warning means associated therewith and positioned with respect to the special key and keyboard so as to increase the force (above the predetermined force) required to actuate the special key. The increase in force provides tactile feedback to an operator of the keyboard before the special key's associated makepoint is reached to thereby warn said operator that he is about to actuate the special key. The warning means is made of resilient material, has a general, washer-like shape, and is positioned under the key cap of the special key.

1 Claim, 9 Drawing Figures

PRIOR ART

MEANS FOR AVOIDING ACCIDENTAL ACTUATION OF A CRITICAL FUNCTION KEY

BACKGROUND OF THE INVENTION

This invention relates to a keyboard, and more specifically, it relates to a means for providing tactile feedback or a warning to a keyboard operator to avoid accidental actuation of a critical function key such as a "Break" or a "Delete" key on the keyboard.

Very often, a critical function key such as "Delete" (which may, for example, eliminate all accumulated data resulting from a series of transactions) is located next to an "Enter" key on the keyboard. It becomes apparent that during the training of an operator using the keyboard, and thereafter, even with an experienced operator, important data is lost because the operator accidentally actuates a critical function such as "Delete" instead of an intended, adjacent "Enter" key. The data which is lost thereby must be re-developed with consequent increases in costs of preparation of the data and a loss of time.

SUMMARY OF THE INVENTION

A preferred embodiment of this invention comprises a keyboard having a plurality of keys thereon, with each key being moveable from a rest position along an actuation path having a makepoint therealong, whereby completion of an electrical circuit is effected by moving a key with a predetermined force along its actuation path to its associated makepoint. Each of the keys has means for restoring it towards its associated rest position, and at least one of said keys is designated as a special key. The special key has warning means associated therewith and positioned with respect to the special key and keyboard so as to increase the force (above the predetermined force) required to actuate the special key, with the increase in force providing tactile feedback to an operator of said keyboard before the special key's associated makepoint is reached to thereby warn the operator that he is about to actuate the special key.

Some of the advantages of this invention are as follows:

(1) The tactile feedback mentioned occurs before an incorrect entry is made because the makepoint of the associated key being depressed cannot be reached without applying an actuating force noticeably greater than that normally applied.

(2) The operator's attention is directed spatially to an area of the keyboard when the special or function key is about to be accidentally depressed. This facilitates the spatial discrimination of the special or function key from the surrounding keys, and it also promotes rapid learning.

(3) The increased force necessary to actuate the function key provides a distinct "feel" compared to the remaining keys on the keyboard. When metal springs, for example, are used as the means for restoring all the keys on the keyboard to a "home" position, the force necessary to depress a key is substantially constant along the actuation path of the key. When this invention is used on a function key, the key action is substantially damped, and the force necessary to depress the key becomes progressively greater as the key is moved from its home position toward its makepoint. This provides a distinct tactile feedback to warn the operator that he is about to actuate a special function key.

(4) Certain keyboards are programmable in that any one of the keys thereon may attain a new significance or function as a result of re-writing associated software programs and the like. This means that a particular function key could appear anywhere on an existing keyboard. This invention facilitates modifying any particular key to distinguish it as a function key. The modifying can be accomplished easily by a customer.

(5) A keyboard which was improperly designed initially by having an "Enter" key next to a "Break" key, for example, may be easily retrofitted by this invention by having the Break key tactilely highlighted.

These advantages and others will be more readily understood in conjunction with the following description, claims and drawing.

DETAILED DESCRIPTION OF THE INVENTION

Figure 1:
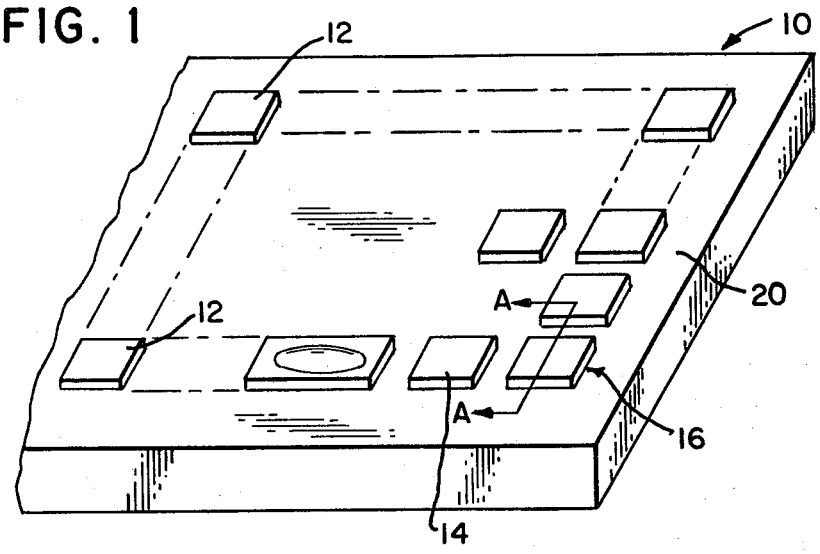
FIG. 1 is a general, perspective view of a portion of a keyboard having a plurality of keys thereon and in which this invention may be used.

FIG. 1 is a general perspective view of a keyboard, designated generally as 10, in which this invention may be used. The keyboard 10 includes a plurality of keys 12 which may be considered general data keys and it also includes, for example, an Entry key 14 and a Delete key 16 which are shown next to each other for purposes of illustration.

As earlier stated herein, when an Entry key 14 is placed near a Delete key 16, valuable data may be lost when the Delete key 16 is accidentally actuated instead of the intended Entry key 14.

Figure 2:
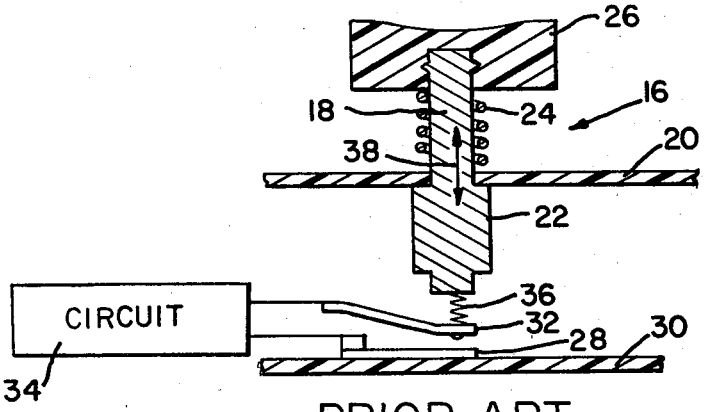
FIG. 2 is a cross-sectional view, taken along the line A—A of FIG. 1, showing a typical prior-art arrangement of a key within a keyboard.

FIG. 2 shows a cross section of the Delete key 16 shown in FIG. 1. The key 16 in FIG. 2 is shown as prior art, and in a prior-art keyboard, all the keys like 12, 14, and 16 would be constructed in the same manner so that all the keys on the associated keyboard would require the same actuation force to actuate a key.

FIG. 2 is, to some degree, a diagrammatic representation of an individual key 16; it was drawn this way so as to facilitate a general description of the various elements and functions associated with a key in a keyboard. Some modular key units, more typical of the state-of-the-art key switches, will be discussed later herein.

The key 16 (FIG. 2) includes a key stem 18 which is inserted through a matching hole in a top mounting plate 20 of the keyboard 10. The stem 18 has an enlarged portion 22 which abuts against the underside of the plate 20 (as viewed in FIG. 2) to limit the upward motion of the stem 18. The means for restoring the key 16 to the home position shown in represented by a compression spring 24 which is positioned between the top of the plate 20 and the underside of a removeable key cap 26 which is detachably secured to the stem 18. The key 16 also includes it associated contacts which are represented by a stationary contact 28 which rests on a stationary insulating plate 30 and a moveable contact 32. The contacts 28 and 32 are connected to an electrical circuit 34. The lower side of the enlarged portion 22 of the key stem 18 has a small compression spring 36 depending therefrom to engage the moveable contact 32.

It will be understood that the present invention could also be employed in a mechanical keyboard, and that the showing in an electrical circuit environment is therefore only illustrative.

The operation of the key 16 shown in FIG. 2 is as follows. When an operator depresses the key cap 26, the key stem 18 moves along the actuation path 38 towards the plate 30 against the bias of spring 24. As the stem 18 is so moved, the small compression spring 36 resiliently forces the moveable contact 32 into engagement with the stationary contact 28 to produce the "makepoint" or to effect the completion of an electrical circuit. The spring 36 provides for the "aftertravel" of the stem 18 along the actuation path 38 after the makepoint is reached and also helps to control the compressive forces exerted on the contacts 28 and 32 so as to minimize damage to them. The sizes of the springs 24 and 36 and other components of the key 16 are conventionally selected to provide the particular predetermined force to actuate the key 16 and to provide the particular length of the actuation path 38 and the particular location of the makepoint along the path 38.

Figure 3:
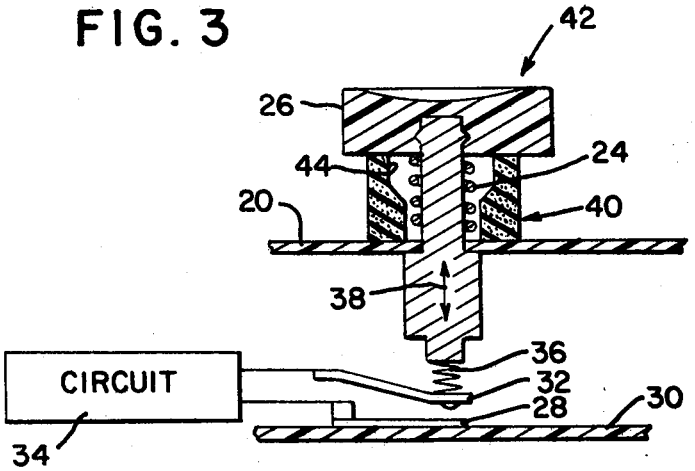
FIG. 3 is a cross-sectional view, taken along the line A—A of FIG. 1, showing a first embodiment of this invention.

FIG. 3 represents one embodiment of this invention which shows a resilient member 40 being positioned between the key cap 26 and the plate 20 for a critical function key 42. The key 42 is indentical to the key 16 shown in FIG. 2 except for the addition of the resilient member 40; accordingly, similar elements shown in FIG. 3 are given the indentical reference numerals used in FIG. 2.

The resilient member 40 (FIG. 3) provides an increase in force above the force (supplied by springs 24 and 36) required to actuate the regular keys like 12 in FIG. 1. The normal force required to actuate a key may be, for example, from about 50 to 100 grams. The increase in force due to the addition of the resilient member should be about 200 grams above the normal force required to actuate a key in the example given. This increase in force provides the tactile feedback to an operator of the keyboard before the associated makepoint of the key 42 is reached to thereby warn the operator that he is about to actuate a critical function key 42 as earlier described.

The overall shape of the resilient member 40 (FIG. 3) is sleeve-like or cylindrical (in the form of a thick washer) although it could be made square, for example, to match the general shape of the keys like 12 and 14 shown in FIG. 1. The cross section of the resilient member 40 is shown in FIG. 3. The member 40 has a reduced wall thickness as shown at area 44 to avoid having that area 44 being abraded by the spring 24 when the member 40 is compressed during actuation of the key 42. The resilient member 40 is made of a resilient material such as foam rubber and the inner surface of the member 40 facing the spring 24 could be manufactured with a smooth surface to prevent the member from being abraded by the spring 24 which might tend to reduce the operating life of the resilient member 40.

Figure 4:
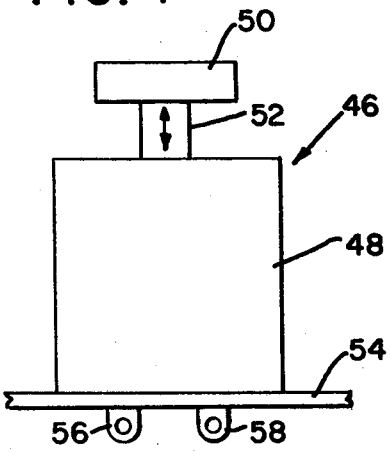
FIG. 4 is an enlarged, side view, in elevation, of a conventional key switch module shown being mounted on a circuit board.

FIG. 4 shows a side, elevational view of a conventional key switch module 46 alluded to earlier herein. The module 46 generally includes a cube-type body 48 with the key cap 50 and key stem 52 extending therefrom as shown. The module 46 is mounted on a support member or a circuit board 54 with the switch lugs 56 and 58 extending therefrom for connection to certain elements on the board 54 or to external circuitry as previously described. The key switch module 46 may be of the type which has mechanical contacts therein or may be of the capacitive coupling type, as is typically done. The module 46 also has a restoring means (not shown) within the body to retrun the key cap 50 to the home position shown in FIG. 4. Because the switch module 46 is conventional, it need not be described in further detail except to state that a plurality of modules such as module 46 are arranged on and mounted on the circuit board 54 to form an arrangement of keys as is shown in FIG. 1.

Figure 5:
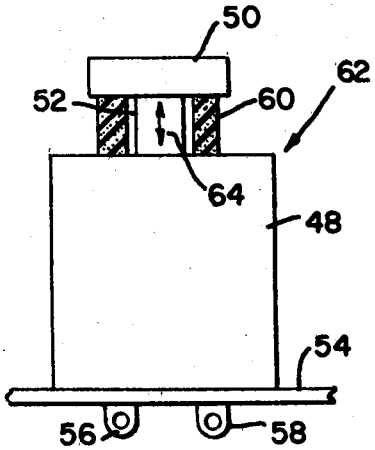
PRIOR ART FIG. 5
FIG. 5 is a view, similar to FIG. 4, showing another embodiment of the resilient member of this invention as it is mounted on a key switch module.
Figure 6:
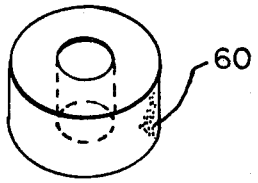
FIG. 6 is a general, perspective view of the resilient member shown in FIG. 5.

FIG. 5 is a view similar to FIG. 4 showing another embodiment of the resilient member 60 which is positioned on a key switch module 62. The member 60 is shown in cross section in FIG. 5 with the cross-sectional line taken along a line similar to line A—A shown in FIG. 1. A perspective view of the member 60 is shown in FIG. 6. The module 62 is identical to the module 46 shown in FIG. 4 except for the addition of the resilient member 60; accordingly, the same reference numerals are used in FIGS. 4 and 5 to represent identical parts. The actuation path for the key stem 52 is shown by reference numeral 64 in FIG. 5.

As previously explained, when the resilient member 60 (FIG. 5) is positioned on a critical function key switch module 62, the increase in actuation force apparent when a keyboard operator attempts to actuate the module 62 provides the tactile feedback to the operator before the module's associated makepoint is reached. This warns the operator that he is about to actuate a critical function key.

Figure 7:
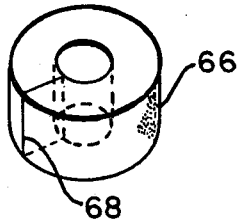
FIG. 7 is a general, perspective view of another embodiment of the resilient member.

Usually, the key cap 50 (FIG. 5) is detachably removeable from the associated key switch module 62 to permit the resilient member 60 to be inserted around the key stem 52; however, if the key cap 50 is not removable, the resilient member 66 shown in FIG. 7 may be used. The resilient member 66 is identical to member 60 except for the fact that it has a cut 68 extending through the member 66 (similar to a "C" washer) to permit it to be expanded and to be inserted around a key stem without having to remove the associated key cap. The member 66 is especially useful for altering existing keyboards in customer's use for those keyboards which do not have removeable key caps.

Figure 8:
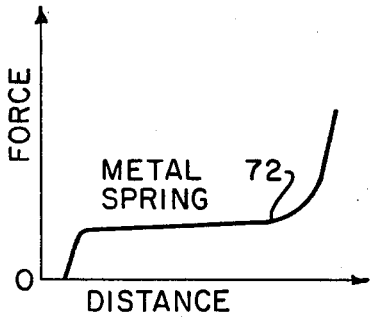
FIG. 8 is a Force-Distance diagram for a metal spring.
Figure 9:
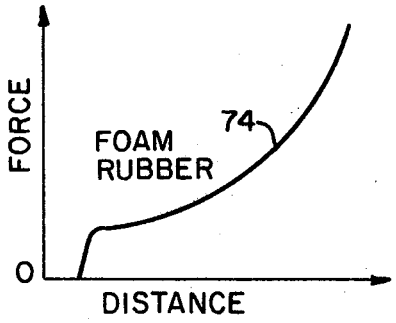
FIG. 9 is a Force-Distance diagram of the resilient member when it is made of a foam rubber.

FIG. 8 is a Force-Distance diagram 72 of a metal spring such as spring 24 shown in FIG. 2. FIG. 9 is a Force-Distance diagram 74 of a resilient member such as 60 when it is made of a resilient material such as foam rubber. Notice that the force (FIG. 8) necessary to compress the spring 24 is substantially constant over a considerable distance in the actuation path prior to increasing. The Force-Distance diagram 74 for the resilient member 60 indicates that the force required to compress the member 60 indicates that the forece required to member 60 is compressed. This action provides a very distinct, tactile feedback to enable an operator to sense that a critical function key is about to be actuated. The key action when using a resilient member such as 60 is considerably damped.

A suitable foam rubber for use in the resilient members 40, 60, and 66, for example, may be one that satisfies the American Society for Testing Materials procedure ASTM-DI564. With this procedure, a one inch thick section of foam rubber having an area of 50 square inches will be compressed to a thickness of $\frac{3}{4}$ inch (representing a 25% compression) when subjected to a force of one pound per square inch.

We claim:

1. A keyboard having a plurality of keys thereon, with each said key being moveable from a rest position along an actuation path having a makepoint therealong, whereby completion of an electrical circuit is effected by moving a said key with predetermined force along its actuation path to its associated said makepoint;

each said key having means for restoring it towards its said rest position;

at least one of said keys being designated as a special key and also having warning means associated therewith and positioned with respect to said special key and keyboard to increase the force above said predetermined force required to actuate said special key, said increase in force providing tactile feedback to an operator of said keyboard before said special key's associated makepoint is reached to thereby warn said operator that he is about to actuate said special key;

said warning means comprising a resilient member;

said special key having a key cap and a key stem; and said resilient member having a shape to enable it to be positioned around said key stem and under said key cap so as to increase the force necessary to actuate said special key;

said restoring means comprising a compression spring which is mounted on said key stem and is located under said key cap; and said resilient member being positioned around said compression spring and also having a reduced wall thickness near said key cap to minimize the abrasion of said resilient member by said compression spring during actuation of said special key.

* * * * *